US008900014B2

(12) United States Patent
Kondo

(10) Patent No.: US 8,900,014 B2
(45) Date of Patent: Dec. 2, 2014

(54) PLUG, JACK, AND CONNECTOR

(71) Applicant: Fujitsu Component Limited, Tokyo (JP)

(72) Inventor: Takahiro Kondo, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 46 days.

(21) Appl. No.: 13/723,805

(22) Filed: Dec. 21, 2012

(65) Prior Publication Data

US 2013/0164991 A1 Jun. 27, 2013

(30) Foreign Application Priority Data

Dec. 27, 2011 (JP) ..... 2011-285124

(51) Int. Cl.

| | |
|---|---|
| ***H01R 24/28*** | (2011.01) |
| ***H01R 12/73*** | (2011.01) |
| *H01R 12/72* | (2011.01) |
| *H01R 13/514* | (2006.01) |

(52) U.S. Cl.

CPC ..... *H01R 24/28* (2013.01); *H01R 12/737* (2013.01); *H01R 12/724* (2013.01); *H01R 13/514* (2013.01)

USPC ..... 439/660

(58) Field of Classification Search

USPC ..... 439/607.05, 607.01, 607.11, 733.1, 439/660, 108

See application file for complete search history.

(56) References Cited

U.S. PATENT DOCUMENTS

| | | | | |
|---|---|---|---|---|
| 3,115,379 | A * | 12/1963 | McKee | 439/290 |
| 6,179,663 | B1 | 1/2001 | Bradley et al. | |
| 6,517,360 | B1 * | 2/2003 | Cohen | 439/65 |
| 6,607,402 | B2 * | 8/2003 | Cohen et al. | 439/607.11 |
| 6,672,907 | B2 * | 1/2004 | Azuma | 439/682 |
| 6,851,980 | B2 * | 2/2005 | Nelson et al. | 439/607.05 |
| 6,918,789 | B2 * | 7/2005 | Lang et al. | 439/607.11 |
| 7,331,802 | B2 * | 2/2008 | Rothermel et al. | 439/108 |
| 7,344,391 | B2 * | 3/2008 | Minich | 439/108 |
| 7,883,366 | B2 * | 2/2011 | Davis et al. | 439/607.01 |
| 2005/0215121 | A1 * | 9/2005 | Tokunaga | 439/608 |

FOREIGN PATENT DOCUMENTS

| | | |
|---|---|---|
| JP | 2004-500684 | 1/2004 |

* cited by examiner

*Primary Examiner* — Alexander Gilman
(74) *Attorney, Agent, or Firm* — IPUSA, PLLC

(57) ABSTRACT

A plug includes a connection part to be connected to a board, a contact, and a conductor part that connects the contact and the connection part. The connection part and the contact are perpendicular to each other. The contact is turned 45 degrees relative to the conductor part about a direction in which the contact extends from the conductor part.

11 Claims, 10 Drawing Sheets

FIG.3A
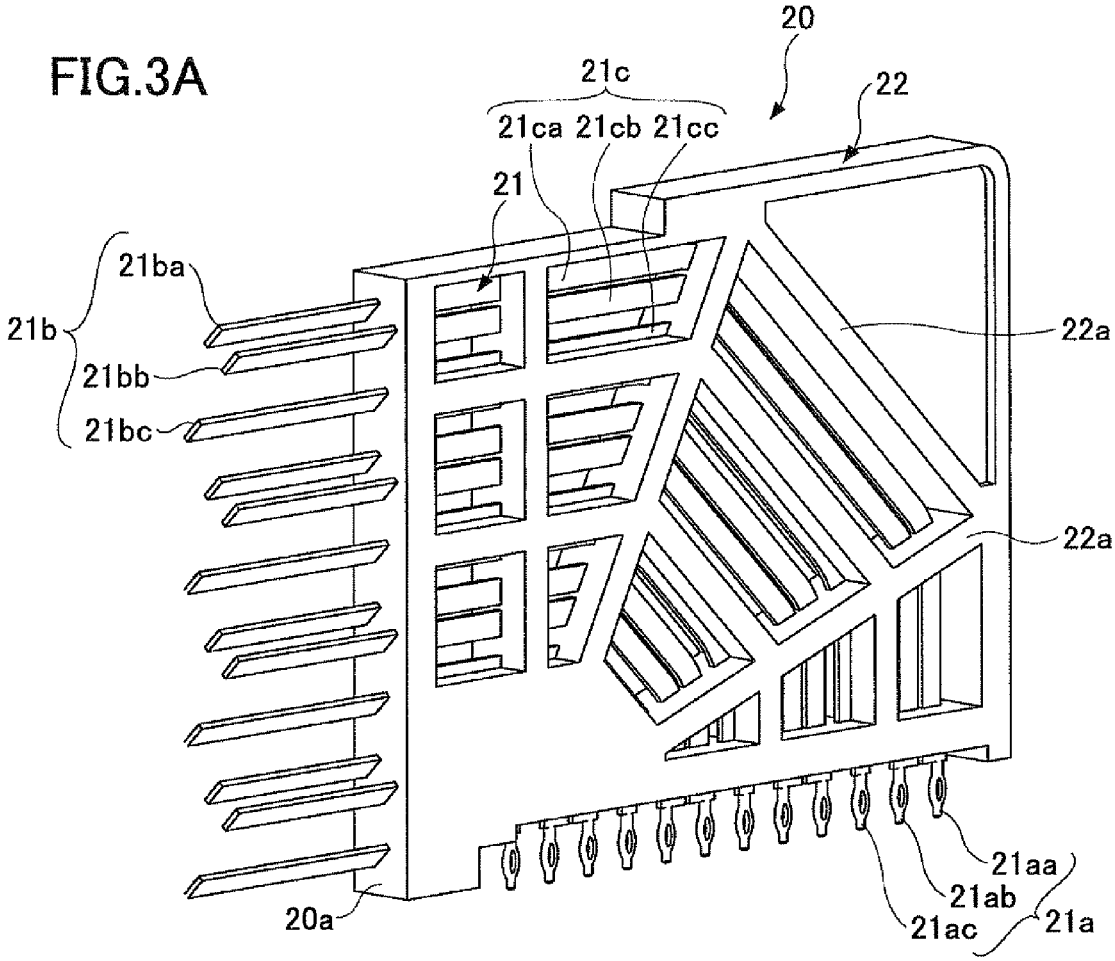
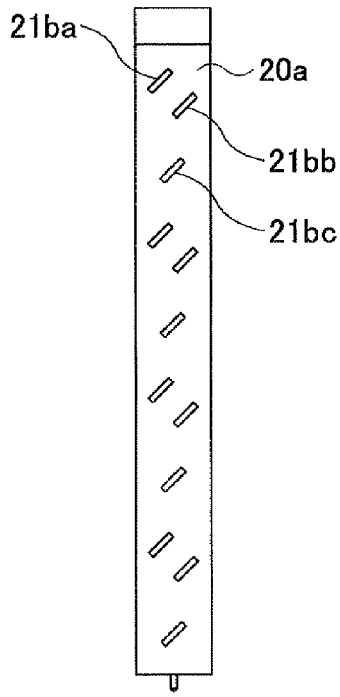
FIG.3B

PLUG, JACK, AND CONNECTOR

CROSS-REFERENCE TO RELATED APPLICATION

The present application is based upon and claims the benefit of priority of the prior Japanese Patent Application No. 2011-285124, filed on Dec. 27, 2011, the entire contents of which are incorporated herein by reference.

BACKGROUND OF THE INVENTION

1. Field of the Invention

The present invention relates to a plug, a jack, and a connector suitably applied to signal exchanges between boards and electrical connections for grounding.

2. Description of the Related Art

In electronic apparatuses, connectors are commonly used, for example, to electrically interconnect boards including a signal line and a ground line in a detachable manner. Examples of connectors for such a purpose include the connector described in Japanese National Publication of International Patent Application No. 2004-500684.

The connector described in Japanese National Publication of International Patent Application No. 2004-500684 employs a right-angle plug connected to a daughter card, which is one board, and a straight-angle jack connected to a mother board, which is another board perpendicular to a butting direction, in connecting the mother board to the daughter card. The right-angle type refers to a connector whose contacts and connection with the daughter card are perpendicular to each other. The straight-angle type refers to a connector whose contacts and connection with the mother board are parallel to each other.

SUMMARY OF THE INVENTION

According to an aspect of the present invention, a plug includes a connection part to be connected to a board; a contact; and a conductor part that connects the contact and the connection part, wherein the connection part and the contact are perpendicular to each other, and the contact is turned 45 degrees relative to the conductor part about a direction in which the contact extends from the conductor part.

According to an aspect of the present invention, a jack includes a connection part to be connected to a board; a contact; and a conductor part that connects the contact and the connection part, wherein the connection part and the contact are perpendicular to each other, and the contact is turned 45 degrees relative to the conductor part about a direction in which the contact extends from the conductor part.

According to an aspect of the present invention, a connector includes a first connector member that includes a plurality of first connection parts to be connected to a first board; a plurality of first contacts; and a plurality of first conductor parts, wherein each of the first conductor parts connects a corresponding one of the first contacts and a corresponding one of the first connection parts, wherein the first connection parts and the first contacts are perpendicular to each other, and each of the first contacts is turned 45 degrees relative to a corresponding one of the first conductor parts about a direction in which each of the first contacts extends from the corresponding one of the first conductor parts; and a second connector member that includes a plurality of second connection parts to be connected to a second board; a plurality of second contacts connected to the first contacts of the first connector member; and a plurality of second conductor parts, wherein each of the second conductor parts connects a corresponding one of the second contacts and a corresponding one of the second connection parts, wherein the second connection parts and the second contacts are perpendicular to each other, and each of the second contacts is turned 45 degrees relative to a corresponding one of the second conductor parts about a direction in which each of the second contacts extends from the corresponding one of the second conductor parts, wherein the first contacts and the second contacts are turned in a same direction.

BRIEF DESCRIPTION OF THE DRAWINGS

FIGS. 3A and 3B are schematic diagrams illustrating a plug module in the plug of the connector according to the embodiment;

DETAILED DESCRIPTION OF THE PREFERRED EMBODIMENTS

As described above, the conventional connector that employs a right-angle connector and a straight-angle connector is used in the form of connection where an end of one board is butted against the surface of another board. However, such a connector is prevented from establishing a proper electrical connection when one board and another board are in a mutually twisted positional relationship and are perpendicular to each other.

According to an aspect of the present invention, a plug that makes it possible to suitably connect boards that are positioned to be twisted relative to each other and are perpendicular to each other, a jack corresponding to the plug, and a connection including the plug and the jack are provided.

According to an aspect of the present invention, a plug to be connected to a first board, a jack to be connected to a second board, and a connector that includes the plug and the jack are provided that make it possible to suitably connect the first board and the second board that are to be connected when the first board and the second board are in a twisted positional relationship where the first board and the second board are perpendicular to each other about a connecting direction. This makes it possible to improve signal transmission quality and to reduce cost.

A description is given, with reference to the accompanying drawings, of one or more embodiments of the present invention.

Figure 1:
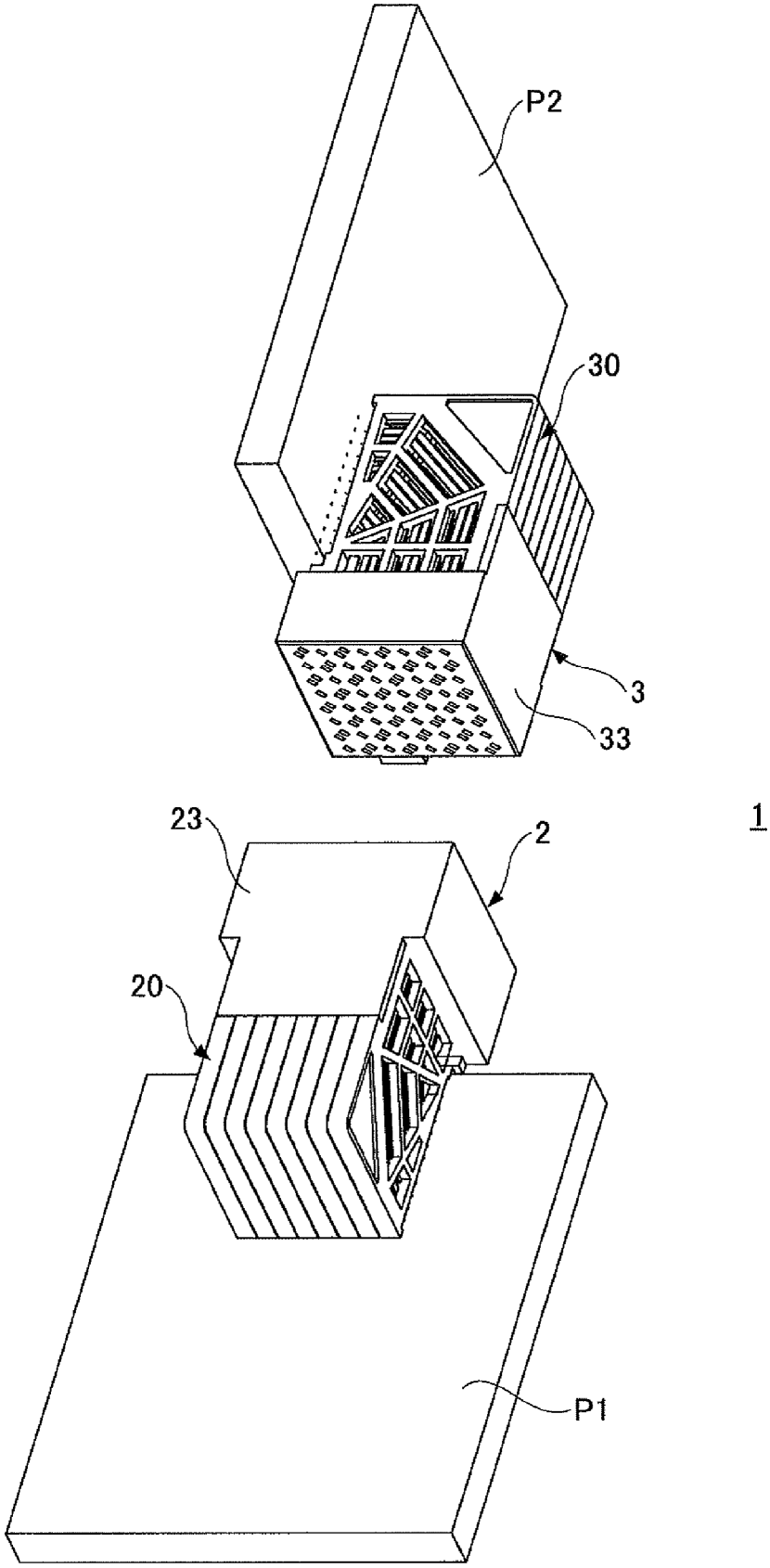
FIG. 1 is a schematic perspective view of a connector according to an embodiment of the present invention, illustrating a plug and a jack before fitting, taken from the plug side.

Referring to FIG. 1, a connector 1 according to an embodiment includes a plug 2 and a jack 3, and a first board P1 and a second board P2 are in a mutually twisted positional relationship and are perpendicular to each other. FIG. 1 is a perspective view of the connector 1 before the plug 2 and the jack 3 are fitted, taken from the plug 2 side. Here, the twisted positional relationship refers to a positional relationship where turning the first board P1 90 degrees about a direction in which the plug 2 and plug 3 are fitted, that is, connected, causes the first board P1 to be parallel to the second board P2.

Figure 2:
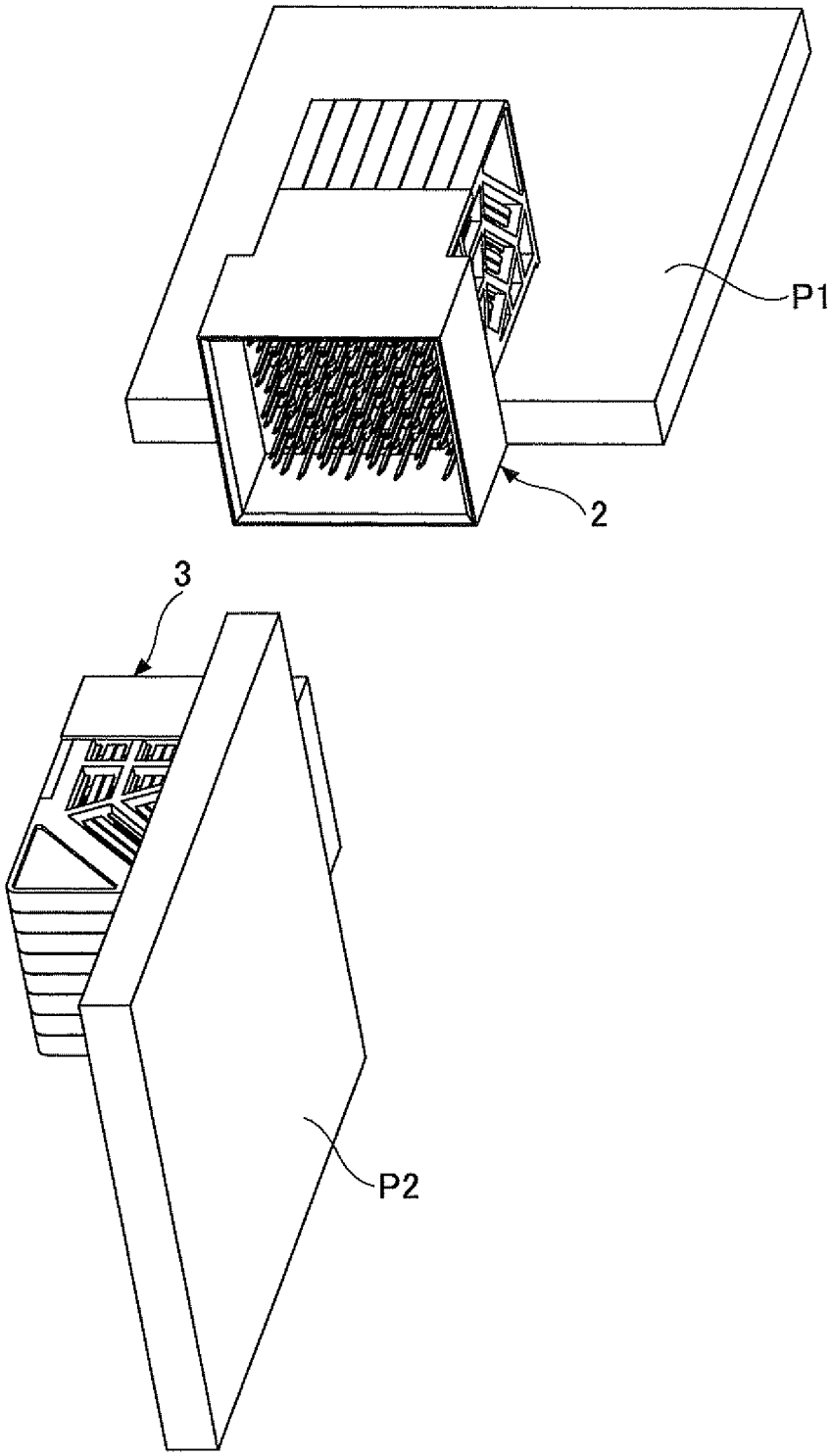
FIG. 2 is a schematic perspective view of the connector before fitting according to the embodiment, taken from the jack side.

FIG. 2 is a perspective view of the connector 1 before the plug 2 and the jack 3 are fitted, taken from the jack 3 side. The first board P1 and the second board P2 are suitably supported by a support structure of a housing, that is, a shell, of an electronic apparatus (not graphically illustrated).

The plug 2 is configured to be mounted on the first board P1. As illustrated in FIG. 1, the plug 2 includes multiple plug modules 20 and a fitting opening part 23. Referring to FIG. 3A along with FIG. 5, each of the plug modules 20 includes multiple first conductor plates 21 and a frame 22. Each of the first conductor plates 21 includes a first connection part 21*a* (a press fit part) configured to be electrically connected to the first board P1, a first contact 21*b*, and a first conductor part 21*c* that connects the first contact 21*b* and the first connection part 21*a*. The first connection part 21*a* and the first contact 21*b* are perpendicular to each other. The first contact 21*b* is turned 45 degrees on its root (an end that continues from the first conductor part 21*c*) relative to the first conductor part 21*c* (that is, the first contact 21*b* is turned 45 degrees relative to the first conductor part 21*c* about a direction in which the first contact 21*b* extends from the first conductor part 21*c*), so that an end of the first contact 21*b* on the side opposite to the root is in a position twisted 45 degrees relative to the position of the root.

Figure 5:
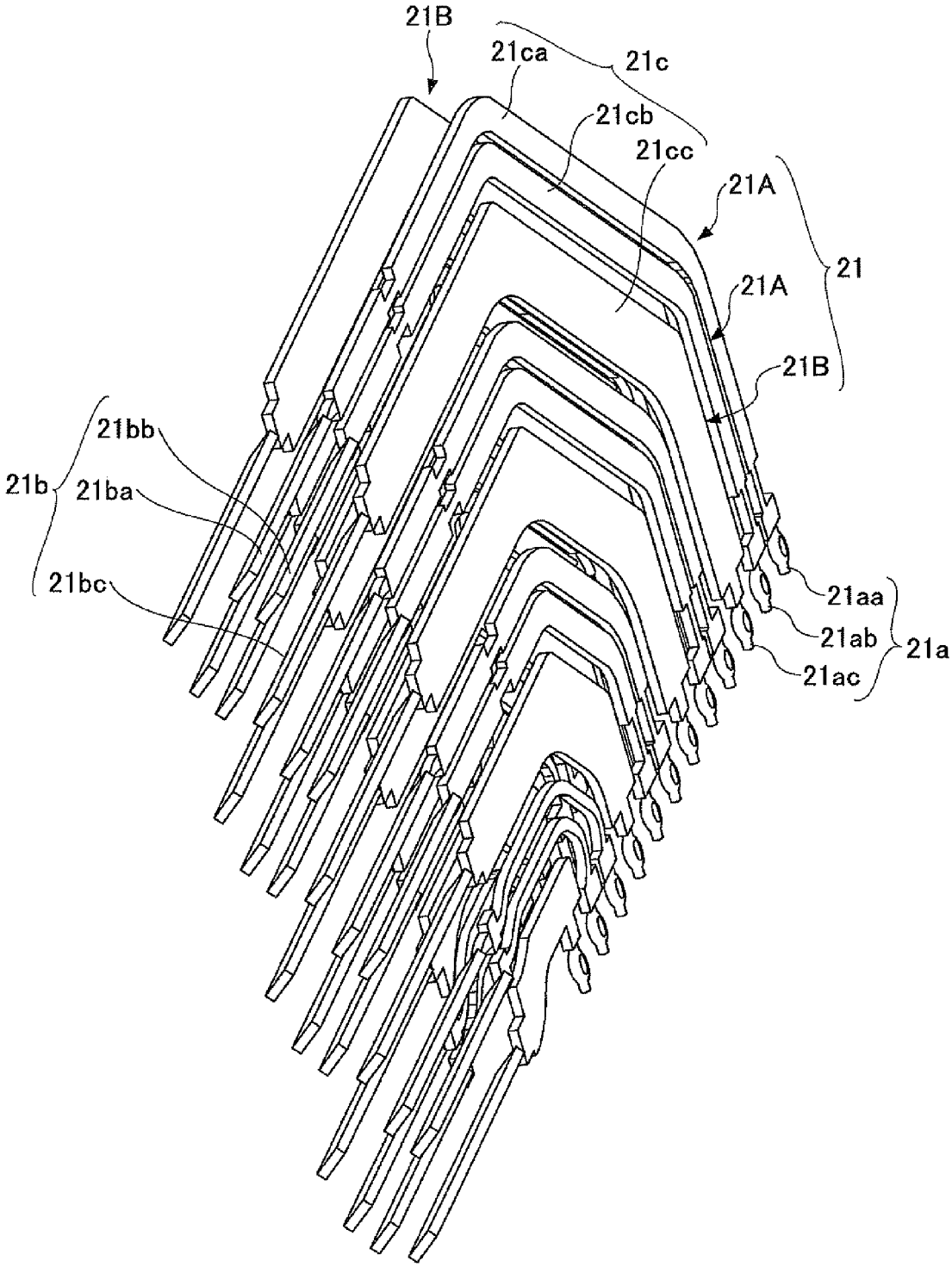
FIG. 5 is a schematic perspective view of conductor plates arranged in the row direction in the plug modules in the plug of the connector according to the embodiment.

Referring to FIG. 5, each of the first conductor plates 21 is shaped like a flat plate having an inverted L-letter shape, and includes two bent parts that are bent at an angle of 135 degrees. The first conductor plates 21 include two kinds of conductor plates: signal conductor plates 21A for signals (signal transmission) and ground conductor plates 21B for grounding.

The signal conductor plates 21A include multiple pairs of the positive (+) signal conductor plate 21A for a positive signal and the negative (−) signal conductor plate 21A for a negative signal. The first contacts 21*b* of each pair of the signal conductor plates 21A are a positive signal contact 21*ba* and a negative signal contact 21*bb*. In correspondence to the positive signal contact 21*ba* and the negative signal contact 21*bb*, the first conductor parts 21*c* of each pair of the signal conductor plates 21A are a positive signal conductor plate 21*ca* and a negative signal conductor plate 21*cb*, and the first connection parts 21*a* of each pair of the signal conductor plates 21A are a positive signal connection part 21*aa* and a negative signal connection part 21*ab*.

The first contact 21*b* of each of the ground conductor plates 21B is a ground contact 21*bc*. The first conductor part 21*c* of each of the ground conductor plates 21B is a ground conductor part 21*cc*. The first connection part 21*a* of each of the ground conductor plates 21B is a ground connection part 21*ac*.

Referring to FIG. 3A and FIG. 5, the first conductor plates 21 having an inverted L-letter shape are arranged so that the four pairs of the signal conductor plates 21A and the four ground conductor plates 21B alternate with each other in a direction from the outside (the outermost side) to the inside (the innermost side) of their bends. The first conductor plates 21 are enclosed by the frame 22. The frame 22 is formed by injection molding using an insulator of suitable material quality. Comparing the direction of the inverted L-letter shape to a circumferential direction, the frame 22 includes suitable skeletal parts 22*a* that extend radially and circumferentially, so that the heat of the first conductor plates 21 is radiated through air gaps (openings) formed between the skeletal parts 22*a*.

FIG. 3B is a view of the plug module 20 of FIG. 3A taken from a fitting direction in which the plug 2 is fit into the jack 3. As illustrated in FIG. 3B, in an opposing plane that faces toward the jack 3 (for example, a surface 20*a* of the plug module 20 or a plane parallel to the surface 20*a*), the pairs of the signal contacts 21*ba* and 21*bb* and the ground contacts 21*bc* are alternately arranged in the above-described direction from the outermost side to the innermost side. In each pair of the signal contacts 21*ba* and 21*bb*, the positive signal contact 21*ba* is in a higher position, and the negative signal contact 21*bb* is in a lower position.

In this case, as illustrated in FIG. 3A, the positive and negative signal connection parts 21*aa* and 21*ab* and the ground connection parts 21*ac* are arranged at equal intervals in the fitting direction in the plane of connection to the first board P1.

Figure 4:
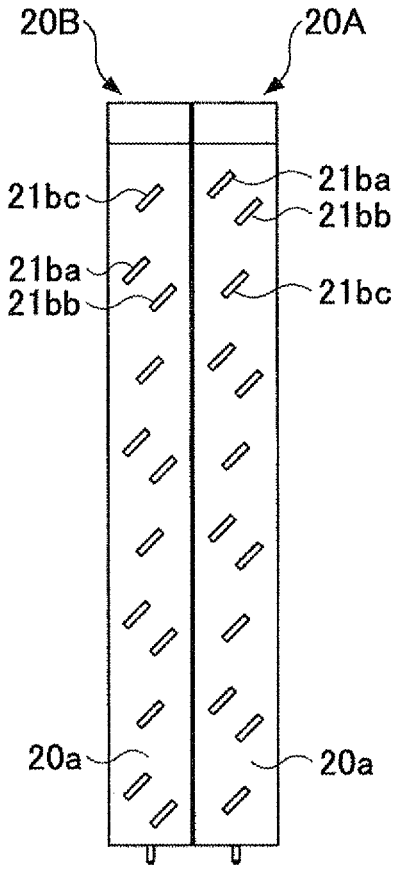
FIG. 4 is a schematic diagram illustrating a terminal arrangement of the adjacent plug modules arranged in a row direction in the plug of the connector according to the embodiment.

Referring to FIG. 4, the plug modules 20 include two different kinds of plug modules 20A and 20B, which are alternately arranged in a row direction of the plug 2 to be adjacent to each other. The plug module 20A has the signal contacts 21*ba* and 21*bb* on the outermost side, that is, at the top, while the plug module 20B has the ground contact 21*bc* at the top.

Correspondingly, in the plane of connection to the first board P1, the ground connection parts 21*ac* and the positive and negative signal connection parts 21*aa* and 21*ab* of the plug module 203 are arranged at equal intervals in the fitting direction while being offset by the half of the equal interval in the fitting direction relative to the ground connection parts 21*ac* and the positive and negative signal connection parts 21*aa* and 21*ab* of the adjacent plug module 20A.

FIG. 5 illustrates an arrangement and formation of a group of the first conductor plates 21 of the plug module 20A and a group of the first conductor plates 21 of the plug module 203. The group of the first conductor plates 21 of the plug module 20A is illustrated on the right side and the group of the first conductor plates 21 of the plug module 20B is illustrated on the left side in FIG. 5. The pairs of the positive and negative signal contacts 21*ba* and 21*bb* alternate with the ground contacts 21*bc* both in a vertical direction, that is, a column direction, and in a lateral direction, that is, the row direction in FIG. 5.

Referring to FIG. 5, the ends of the positive signal contacts 21*ba* and the negative signal contacts 21*bb* are in positions twisted 45 degrees in the same direction relative to the positions of their roots on the side of the positive and negative signal conductor parts 21*ca* and 21*cb* of the first conductor plates 21. The positive signal contacts 21*ba* are turned while being offset leftward in FIG. 5 relative to the positive signal conductor parts 21*ca*. The negative signal contacts 21*bb* are turned while being offset rightward in FIG. 5 relative to the negative signal conductor parts 21*cb*.

That is, the positive signal contact 21*ba* and the negative signal contact 21*bb* of each pair are turned in the same direction while being offset in opposite directions in the row direction in the opposing plane so as to be parallel to each other while facing each other in the opposing plane. That is, in the opposing plane, the outlines of the respective rectangular shapes of the positive signal contacts 21*ba* and the negative signal contacts 21*bb* are parallel to each other, and the positive signal contacts 21*ba* and the negative signal contacts 21*bb* are arranged with their respective longitudinal (lengthwise) ends of the rectangular shapes being aligned.

Here, each of the first conductor plates 21 is formed by suitably performing processing such as press working and bending on a single elastic member of, for example, a copper alloy, having electrical conductivity and elasticity. That is, the above-described turning is performed during this process. The surfaces of the first contacts 21*b* of the first conductor plates 21 may be suitably subjected to plating.

Referring to FIG. 5, in each pair of the signal conductor parts 21*c*, the positive signal conductor part 21*ca* is positioned outside the negative signal conductor part 21*cb*. The positive and negative signal conductor parts 21*ca* and 21*cb* have an overall shape of an inverted L letter, and are substantially equal in width in a radial direction to the corresponding ground conductor part 21*cc* positioned inside the positive and negative signal conductor parts 21*ca* and 21*cb*. According to this embodiment, as illustrated in FIG. 5, four groups of signal terminals and four groups of ground terminals are arranged in a direction from the outermost side to the innermost side.

Figure 6:
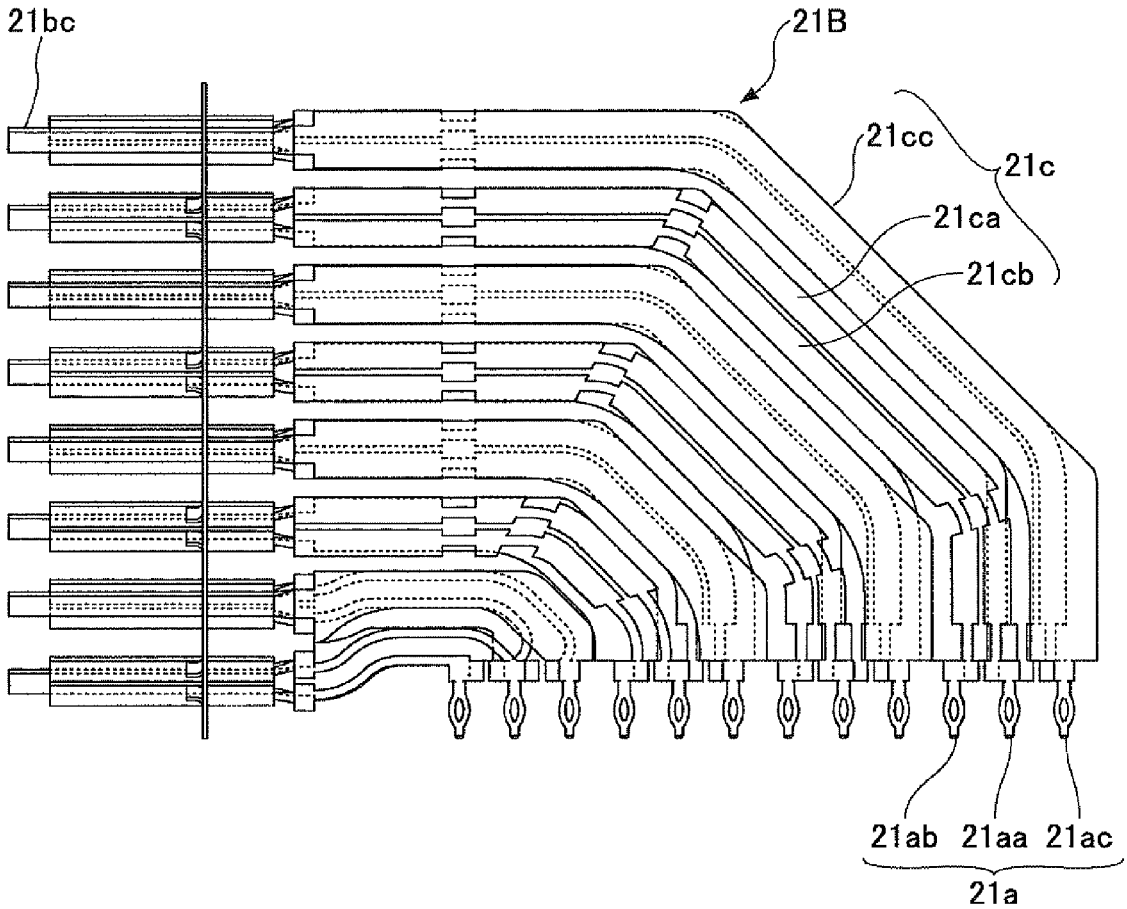
FIG. 6 is a schematic side view of the conductor plates in the plug module in the plug of the connector according to the embodiment.

The positive signal conductor part 21*ca* and the negative signal conductor part 21*cb* of the signal conductor plates 21 on the innermost side are smaller in width (narrower) in a radial direction than the positive signal conductor parts 21*ca* and the negative signal conductor parts 21*cb* of the other signal conductor plates 21. Further, as illustrated in FIG. 6, in the group of the first conductor plates 21 of the plug module 20B, the ground first conductor plate 21B is positioned on the outermost side, and the pairs of the signal first conductor plates 21A and the ground first conductor plates 21B are alternately arranged toward the innermost side.

As illustrated in FIG. 1, these plug modules 20A and 20B of different kinds are alternately stacked in eight rows in the row direction and are combined into a unit by the fitting opening part 23 that allows fitting into the jack 3, so that the plug 2 is formed. The fitting opening part 23 is formed by performing injection molding using an insulator of suitable material quality.

By thus configuring the plug 2, in the plane of connection to the first board P1, the positive and negative signal connection parts 21*aa* and 21*ab* and the ground connection parts 21*ac* are alternately arranged in the row direction, so that a staggered terminal arrangement is achieved.

Figure 7A:
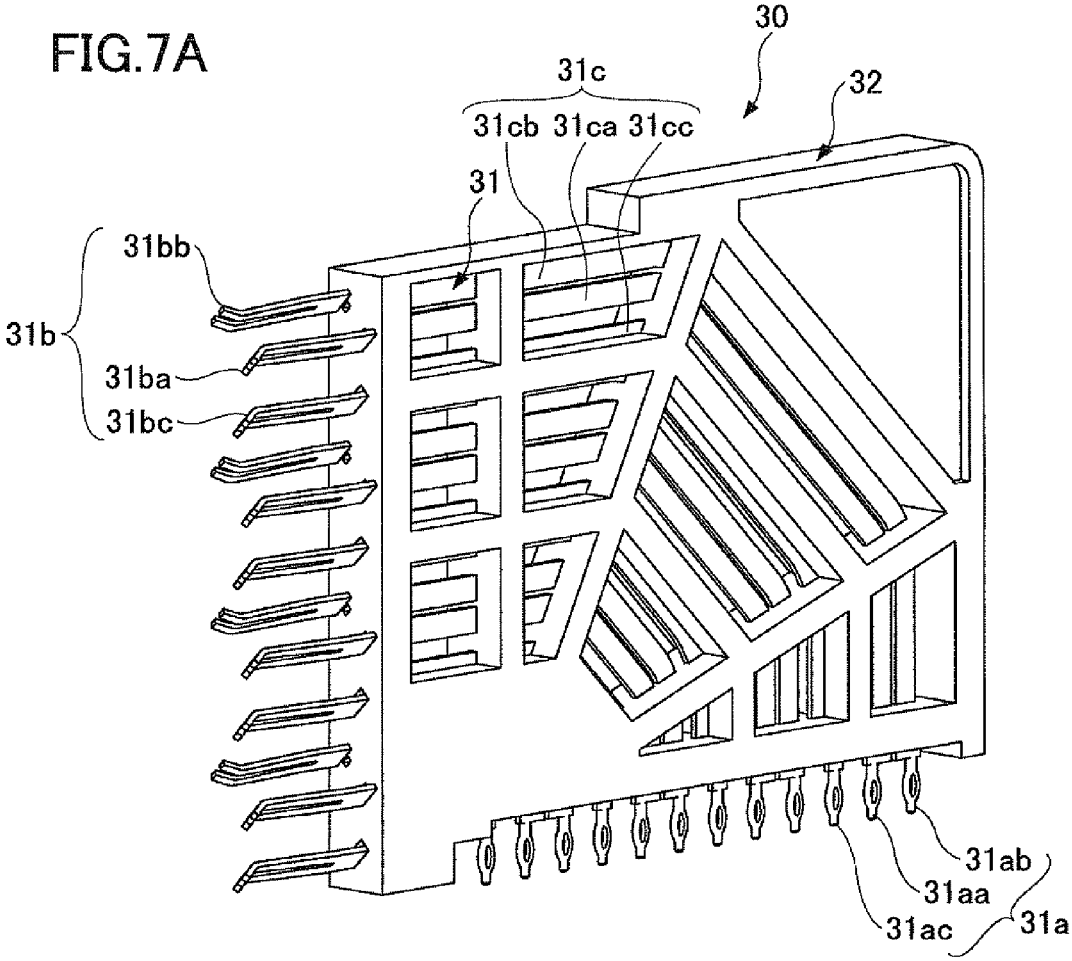
FIGS. 7A and 7B are schematic diagrams illustrating a jack module in the jack of the connector according to the embodiment.

The jack 3 is configured to be mounted on the second board P2. As illustrated in FIG. 1, the jack 3 includes multiple jack modules 30 and a fitting opening part 33. Referring to FIG. 7A, each of the jack modules 30 includes multiple second conductor plates 31 and a frame 32. Each of the second conductor plates 31 includes a second connection part 21*a* configured to be electrically connected to the second board P2, a second contact 31*b* corresponding to the first contact 21*b* of the plug 2, and a second conductor part 31*c* that connects the second contact 31*b* and the second connection part 31*a*. The second connection part 31*a* and the second contact 31*b* are perpendicular to each other. The second contact 31*b* is turned 45 degrees on its root (an end that continues from the second conductor part 31*c*) relative to the second conductor part 31*c* (that is, the second contact 31*b* is turned 45 degrees relative to the second conductor part 31*c* about a direction in which the second contact 31*b* extends from the second conductor part 31*c*), so that an end of the second contact 31*b* on the side opposite to the root is in a position twisted 45 degrees relative to the position of the root. The second conductor plates 31 have the same configuration as the first conductor plates 21 of the plug 2 as illustrated in FIG. 3A except for the second contacts 31*b*, so that a semi-finished product before the turning process in press working is common to the plug 2 and the jack 3.

Each of the second contacts 31*b* includes an inclined part that is inclined (angled) relative to the fitting direction and a bifurcate part that is bifurcated into two portions in correspondence to the first contacts 21*b* of the plug 2, so that when the plug 2 and the jack 3 are fit to each other, the second contacts 31 are pressed aside (sideward) by the inserted first contacts 21*b* to ensure contact pressure.

The second conductor plates 31 include two kinds of conductor plates: signal conductor plates for signals (signal transmission) and ground conductor plates for grounding.

The signal conductor plates include multiple pairs of the positive (+) signal conductor plate for a positive signal and the negative (−) signal conductor plate for a negative signal. The second contacts 31*b* of each pair of the signal conductor plates 31 are a positive signal contact 31*ba* and a negative signal contact 31*bb*. In correspondence to the positive signal contact 31*ba* and the negative signal contact 31*bb*, the second conductor parts 31*c* of each pair of the signal conductor plates 31 are a positive signal conductor plate 31*ca* and a negative signal conductor plate 31*cb*, and the second connection parts 31*a* of each pair of the signal conductor plates 31 are a positive signal connection part 31*aa* and a negative signal connection part 31*ab*.

The second contact 31*b* of each of the ground conductor plates 31 is a ground contact 31*bc*. The second conductor part 31*c* of each of the ground conductor plates 31 is a ground conductor part 31*cc*. The second connection part 31*a* of each of the ground conductor plates 31 is a ground connection part 31*ac*.

In this case as well, the positive and negative signal connection parts 31*aa* and 31*ab* and the ground connection parts 31*ac* are arranged at equal intervals in the fitting direction in the plane of connection to the second board P2. The second conductor plates 31 are enclosed by the frame 32 to form the jack module 30. Like the frame 22 of the plug 2, the frame 32 is formed by injection molding using an insulator of suitable material quality. Like in the plug 2, by alternating the jack modules 30 of two different kinds in the row direction and offsetting their terminal arrangements in the fitting direction, the positive and negative signal connection parts 31*aa* and 31*ab* and the ground connection parts 31*ac* are alternately arranged in the row direction, so that a staggered terminal arrangement is achieved.

Referring to FIG. 7A, the ends of the positive signal contacts 31*ba* and the negative signal contacts 31*bb* are in positions twisted 45 degrees in the same direction relative to the positions of their roots on the side of the positive and negative signal conductor parts 31*ca* and 31*cb* of the second conductor plates 31. The positive signal contacts 31*ba* are turned while being offset rightward in FIG. 7B relative to the positive signal conductor parts 31*ca*. The negative signal contacts 31*bb* are turned while being offset leftward in FIG. 7B relative to the negative signal conductor parts 31*cb*.

Figure 7B:
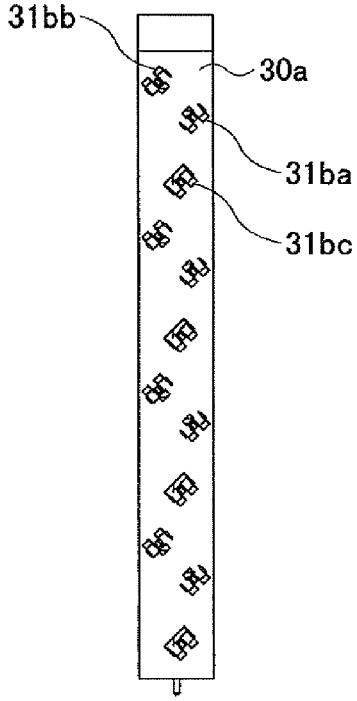

That is, the positive signal contact 31*ba* and the negative signal contact 31*bb* of each pair are turned in the same direction while being offset in opposite directions in the row direction in an opposing plane that faces toward the plug 2 (for example, a surface 30*a* of the plug module 30 or a plane parallel to the surface 30*a*) so as to be parallel to each other while facing each other in the opposing plane. That is, as illustrated in FIG. 7B, in the opposing plane, the positive signal contacts 31*ba* and the negative signal contacts 31*bb* are arranged with the width directions of their respective bifurcate shapes (in which the two portions of the bifurcate shapes are arranged) being parallel to each other and the respective widthwise ends of the bifurcate shapes being aligned.

Here, each of the second conductor plates 31 as well is formed by suitably performing processing such as press working and bending on a single elastic member of, for example, a copper alloy, having electrical conductivity and elasticity. The surfaces of the second contacts 31*b* of the second conductor plates 31 may be suitably subjected to plating.

As illustrated in FIG. 1, these jack modules 30 of different kinds are alternately stacked in eight rows in the row direction and are combined into a unit by the fitting opening part 33 that allows fitting to the plug 2, so that the jack 3 is formed. The fitting opening part 33 also is formed by performing injection molding using an insulator of suitable material quality.

Figure 8:
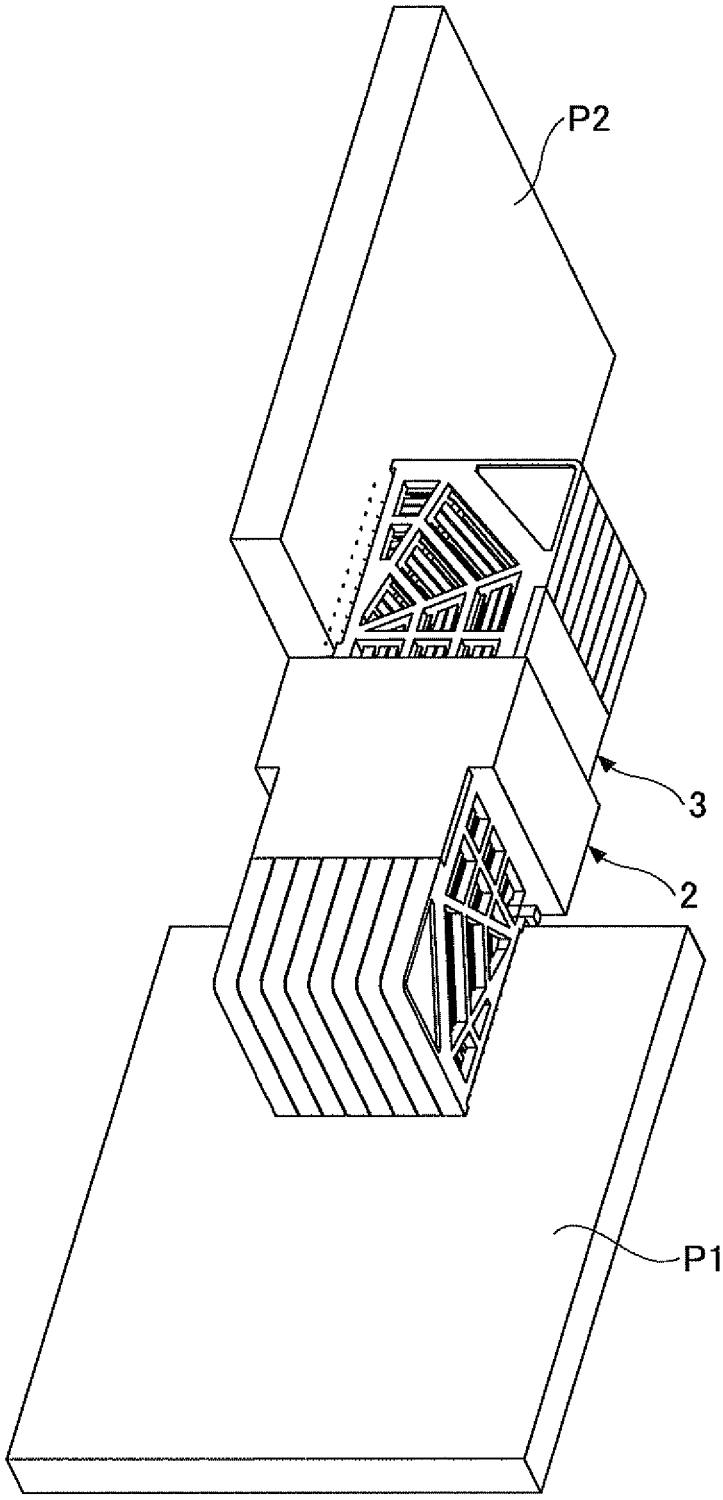
FIG. 8 is a schematic perspective view of the connector after fitting according to the embodiment.

Here, as illustrated in FIG. 1 and FIG. 2, the first contacts 21*b* and the second contacts 31*b* are turned in the same direction in the opposing plane. This allows the plug 2 and the jack 3 to be fit to each other as illustrated in FIG. 8.

When the first contacts 21*b* and the second contacts 31*b* are viewed from the fitting direction with the plug 2 and the jack 3 being fit to each other, the first and second contacts 21*b* and 31*b* are arranged in a matrix, and of adjacent combinations of the first and second contacts 21*b* and 31*b* in the column direction, one is for grounding and the other is for signals (signal transmission). The first contacts 21*b* are arranged in the column direction in each of the plug modules 20 that are provided row by row. The second contacts 31*b* are arranged in the column direction in each of the jack modules 30 that are provided row by row.

Further, of adjacent combinations of the first and second contacts 21*b* and 31*b* in the row direction, one is for grounding and the other is for signals (signal transmission). Further, the first conductor parts 21*c* and the second conductor parts 31*c* are arranged in a matrix, and of adjacent combinations of the first and second conductor parts 21*c* and 31*c* in each of the column direction and the row direction, one is for grounding and the other is for signals (signal transmission).

Figure 9:
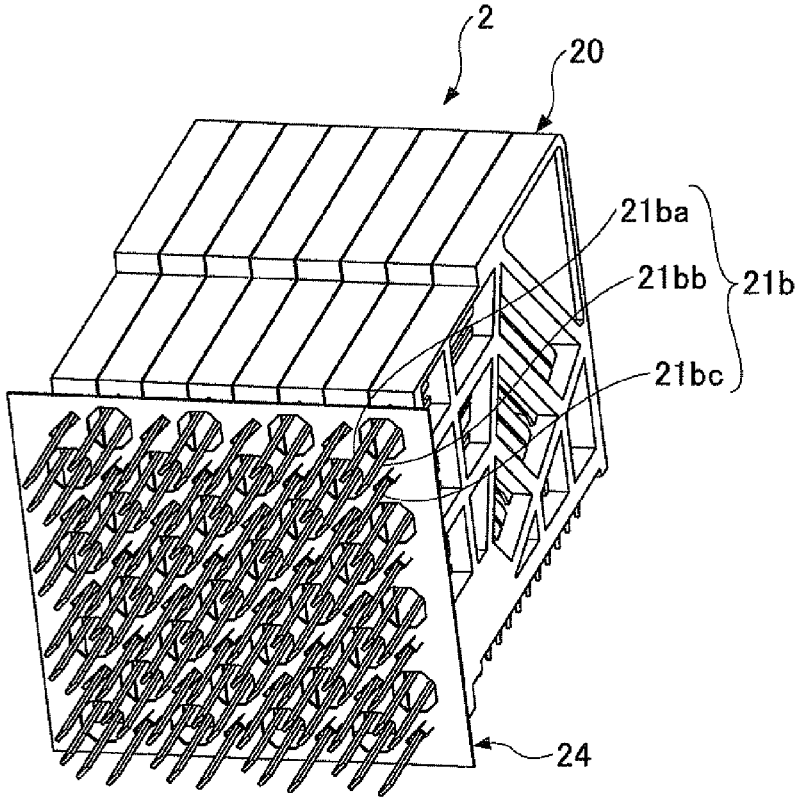
FIG. 9 is a schematic perspective view of the plug of the connector according to the embodiment, illustrating a ground metal plate (a metal plate for grounding) included in the plug.
Figure 10:
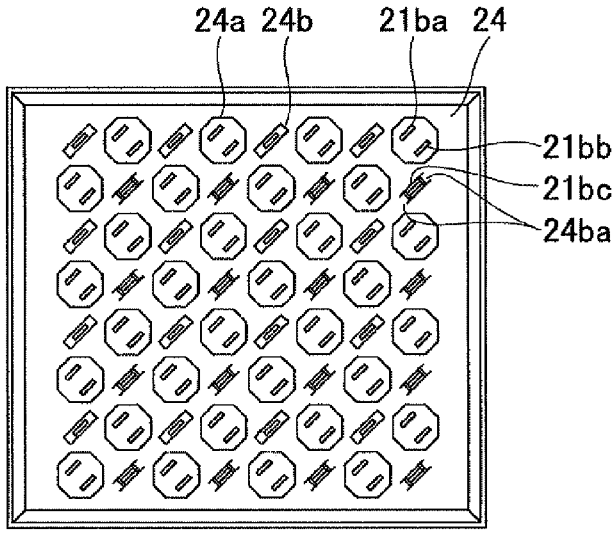
FIG. 10 is a schematic diagram illustrating a terminal arrangement of the plug of the connector with the ground metal plate according to the embodiment.

In addition, as illustrated in FIG. 9, the connector 1 may further include a ground metal plate (a metal plate for grounding) that electrically connect the ground contacts 21*bc* to each other. As illustrated in FIG. 10, the outline of the ground metal plate 24 has a rectangular shape so as to allow the ground metal plate 24 to be housed inside the fitting opening part 23 of the plug 2. The ground metal plate 24 includes multiple holes 24*a* of, for example, an octagonal shape that avoid contact with the corresponding pairs of the positive and negative signal contacts 21*ba* and 21*bb* of the plug 2. The ground metal plate 24 further includes fitting holes 24*b*. Each of the fitting holes 24*b* is fittable to the side surfaces of the ground contact 21*b* other than its contact surface that comes into contact with the ground contact 31*b* and the surface facing away from the contact surface.

Figure 11:
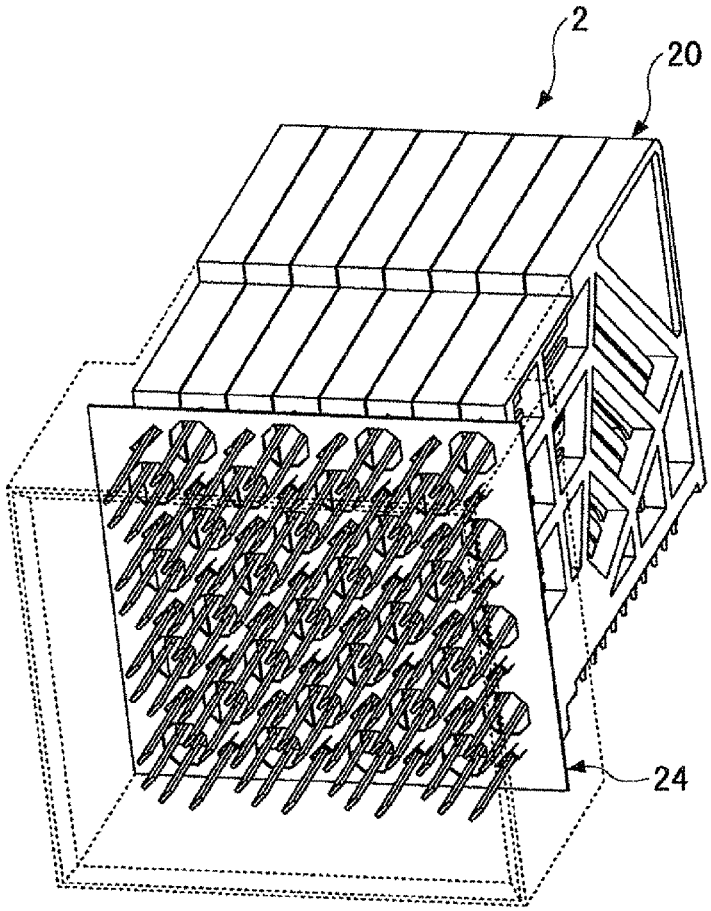
FIG. 11 is a schematic perspective view of the ground metal plate, a fitting opening part, and the plug modules of the plug of the connector in an assembled state according to the embodiment.

Each of the fitting holes 24*b* is provided with a pair of holding parts 24*ba* that holds the side surfaces of the ground contact 21*b* from each side. Referring to FIG. 11, when attaching the ground metal plate 24 to the plug 2 by sliding the ground metal plate 24 backward (in the direction opposite to the fitting direction), each of the holes 24*a* allow the corresponding pair of the positive and negative signal contacts 21*ba* and 21*bb* to pass through forward (in the fitting direction), and each of the fitting holes 24*b* allows the holding parts 24*ba* alone to come into contact with the side surfaces of the corresponding ground contact 21*bc*. As a result, the ground metal plate 24 is fixed relative to the ground contacts 21*bc* of the plug 2, and is connected to a suitable ground path (not graphically illustrated) to ground the multiple ground contacts 21*bc* together.

In the above-described embodiment, the column direction refers to an in-plane direction perpendicular to a plane of contact to a board to which the plug 2 and the jack 3 connect in the plug 2 and the jack 3, respectively, and is a direction in which terminals are arranged in the plug modules 20 and the jack modules 30. The row direction refers to a direction in which the plug modules 20 and the jack modules 30 are stacked (arranged) in the plug 2 and the jack 3, respectively. The fitting direction is a direction perpendicular to both the column direction and the row direction.

The above-described connector 1 according to this embodiment produces advantageous effects as follows. That is, even when the first board P1 and the second board P2 are perpendicular to each other, the first board P1 and the second board P2 may be electrically connected without interposing a so-called backplane that is perpendicular to both the first board P1 and the second board P2 between the first board P1 and the second board P2 by connecting the plug 2 and the jack 3 to the first board P1 and the second board P2, respectively, and fitting the plug 2 and the jack 3 to each other.

This configuration makes it possible to prevent signal degradation due to transmission by avoiding an increase in contact resistance and impedance mismatching by reducing the number of contacts in connection paths and omitting the above-described backplane and its connector components in electrically connecting electronic components on the first board P1 and electronic components on the second board P2. Further, it is also possible to reduce cost by reducing the number of components.

Further, by providing different kinds of modules for each of a group of the plug modules 20A of the plug 2 and a group of the jack modules 30 of the jack 3 and alternating signal terminals with ground terminals in the row and the column direction, it is possible to connect the first board P1 and the second board P2 by fitting the plug 2 and the jack 3 to each other even when the relative positions of the first board P1 and the second board P2 illustrated in FIG. 1 are rotated 180 degrees.

Further, since it is possible to omit a backplane, consideration may be given to application to a relatively large electronic apparatus such as a large-size server or a supercomputer, where multiple first boards P1 and multiple second boards P2 are connected by the connector 1 including the plug 2 and the jack 3. In this case, the direction of cooling air that cools the electronic components of the multilayer first boards P1 and the direction of cooling air that cools the electronic components of the multilayer second boards P2 may be aligned with the fitting direction of the connector 1, thereby making it possible to simplify a flow of cooling air. By thus simplifying a flow of cooling air, the number of installed fan motors is reduced, so that it is possible to reduce cost.

In addition, even without the above-described backplane, signal transmission between any combination of two or more of the multilayer first boards P1 may be performed by any of the multilayer second boards P2, and conversely, signal transmission between any combination of two or more of the multilayer second boards P2 may be performed by any of the multilayer first boards P1.

Further, by arranging terminals in a matrix with a ground terminal and signal terminals being adjacent to each other, it is possible to improve transmission characteristics. Further, the signal terminals may be a positive terminal and a negative terminal for differential transmission. This also makes it possible to improve transmission characteristics.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, in the above-described embodiment, the plug 2 and the jack 3 employ a press-fit shape for a connection part that connects to a board, while a through hole of the board corresponding to the press-fit shape may be replaced with a pad, and the press-fit shape may be replaced with a contact shape or a shape for soldering.

Further, in the above-described embodiment, the signal contacts 21*ba* and 21*bb* are positive and negative terminals and the signal contacts 31*ba* and 31*bb* are positive and negative terminals in consideration of improvement of transmission characteristics due to differential transmission. However, the signal contacts 21*ba* and 21*bb* may be replaced with a single signal contact, and the signal contacts 31*ba* and 31*bb* may be replaced with a single signal contact. The matrix formed by a terminal arrangement is not limited to the above-described square matrix, and may be a non-square matrix.

Embodiments of the present invention are related to a connector, and includes a plug, a jack, and a connector including the plug and the jack that make it possible to establish suitable electrical connection between a first board and a second board that are twisted relative to each other in a positional relationship. Therefore, embodiments of the present invention are beneficially applied to industrial electronic apparatuses that are particularly desired to be cooled with more efficiency among configurations where both the first board and the second board are multilayered. Embodiments of the present invention may also be applied to home and office electronic apparatuses.

What is claimed is:

1. A plug, comprising:

a first module including a first set of connection parts to be connected to a board, a first set of contacts, and a first set of conductor parts that connect the first set of connection parts and the first set of contacts; and a second module including a second set of connection parts to be connected to the board, a second set of contacts, and a second set of conductor parts that connect the second set of connection parts and the second set of contacts;

wherein the connection parts and the contacts are perpendicular to each other, wherein the contacts are turned 45 degrees relative to the conductor parts about a direction in which the contacts extend from the conductor parts, wherein the first set of contacts includes first ground contacts for grounding and first signal contacts for signal transmission, wherein the second set of contacts includes second ground contacts for grounding and second signal contacts for signal transmission, wherein the first ground contacts and first signal contacts are arranged so as to alternate with each other in a first direction, and wherein the second ground contacts and the second signal contacts are arranged so as to alternate with each other in the first direction, and wherein the first ground contacts and the second signal contacts are arranged so as to alternate with each other in a second direction, and wherein the second ground contacts and the first signal contacts are arranged so as to alternate with each other in the second direction.

2. A jack, comprising:

a first module including a first set of connection parts to be connected to a board, a first set of contacts, and a first set of conductor parts that connect the first set of connection parts and the first set of contacts; and a second module including a second set of connection parts to be connected to the board, a second set of contacts, and a second set of conductor parts that connect the second set of connection parts and the second set of contacts;

wherein the connection parts and the contacts are perpendicular to each other, wherein the contacts are turned 45 degrees relative to the conductor parts about a direction in which the contacts extend from the conductor parts, wherein the first set of contacts includes first ground contacts for grounding and first signal contacts for signal transmission, wherein the second set of contacts includes second ground contacts for grounding and second signal contacts for signal transmission, wherein the first ground contacts and first signal contacts are arranged so as to alternate with each other in a first direction, and wherein the second ground contacts and the second signal contacts are arranged so as to alternate with each other in the first direction, and wherein the first ground contacts and the second signal contacts are arranged so as to alternate with each other in a second direction, and wherein the second ground contacts and the first signal contacts are arranged so as to alternate with each other in the second direction.

3. A connector, comprising:

a first connector member that includes a first module including a first set of first connection parts to be connected to a first board, a first set of first contacts, and a first set of first conductor parts; and a second module including a second set of first connection parts to be connected to the first board, a second set of first contacts, and a second set of first conductor parts;

wherein each of the first conductor parts connects a corresponding one of the first contacts and a corresponding one of the first connection parts, wherein the first set of first contacts includes first ground contacts for grounding and first signal contacts for signal transmission, wherein the second set of first contacts includes second ground contacts for grounding and second signal contacts for signal transmission, wherein the first connection parts and the first contacts are perpendicular to each other, wherein each of the first contacts is turned 45 degrees relative to a corresponding one of the first conductor parts about a direction in which each of the first contacts extends from the corresponding one of the first conductor parts;

wherein the first ground contacts and first signal contacts are arranged so as to alternate with each other in a first direction, and wherein the second ground contacts and the second signal contacts are arranged so as to alternate with each other in the first direction, and wherein the first ground contacts and the second signal contacts are arranged so as to alternate with each other in a second direction, and wherein the second ground contacts and the first signal contacts are arranged so as to alternate with each other in the second direction; and a second connector member that includes a plurality of second connection parts to be connected to a second board;

a plurality of second contacts connected to the first contacts of the first connector member; and a plurality of second conductor parts, wherein each of the second conductor parts connects a corresponding one of the second contacts and a corresponding one of the second connection parts, wherein the second connection parts and the second contacts are perpendicular to each other, and each of the second contacts is turned 45 degrees relative to a corresponding one of the second conductor parts about a direction in which each of the second contacts extends from the corresponding one of the second conductor parts, wherein the first contacts and the second contacts are turned in a same direction.

4. The connector as claimed in claim 3, wherein the first contacts are arranged in a matrix, and the ground contacts and the signal contacts are alternately arranged to be adjacent to each other.

5. The connector as claimed in claim 4, wherein the first module and the second module each include a frame that encloses corresponding ones of the first connection parts, the first contacts, and the first conductor parts, and the first module and the second module are provided in a row direction of the matrix, so that the first contacts are arranged in a column direction of the matrix in each of the modules.

6. The connector as claimed in claim 4, wherein the ground contacts and the signal contacts are adjacent to each other in a row direction of the matrix.

7. The connector as claimed in claim 6, wherein the first conductor parts include ground conductor parts for grounding and signal conductor parts for signal transmission, and the ground conductor parts and the signal conductor parts are alternately arranged to be adjacent to each other in the row direction.

8. The connector as claimed in claim 7, wherein each of the signal contacts includes a positive signal contact and a negative signal contact, each of the signal conductor parts includes a positive signal conductor part and a negative signal conductor part that correspond to the positive signal contact and the negative signal contact, respectively, and the first connection parts include signal connection parts for signal transmission, and each of the signal connection parts includes a positive signal connection part and a negative signal connection part that correspond to the positive signal contact and the negative signal contact, respectively.

9. The connector as claimed in claim 8, wherein the first connection parts further include ground connection parts for grounding, and the signal connection parts and the ground connection parts are alternately arranged at equal intervals in a fitting direction in which the first connection member is fit into the second connection member.

10. The connector as claimed in claim 9, wherein the signal connection parts and the ground connection parts are alternately arranged in the row direction.

11. The connector as claimed in claim 4, further comprising:

a ground metal plate that electrically connects ground terminals for grounding of the first contacts.

* * * * *